United States Patent [19]

Davidson et al.

[11] 4,386,573

[45] Jun. 7, 1983

[54] EMBROIDERY ATTACHMENT FOR ELECTRONIC SEWING MACHINE

[75] Inventors: Donald R. Davidson, Berkeley Heights, N.J.; Gerhard Reinert, Bayside, N.Y.

[73] Assignee: The Singer Company, Stamford, Conn.

[21] Appl. No.: 435,531

[22] Filed: Oct. 20, 1982

[51] Int. Cl.[3] ..... D05C 9/06; D05B 3/02

[52] U.S. Cl. ..... 112/103; 112/121.12; 112/158 E

[58] Field of Search ..... 112/158 E, 121.12, 103, 112/102, 121.11, 121.15

[56] References Cited

U.S. PATENT DOCUMENTS

| | | | |
|---|---|---|---|
| 2,895,439 | 6/1959 | Lipfert | 112/308 |
| 3,016,030 | 1/1962 | Adler | 112/161 |
| 3,127,856 | 4/1964 | Taketomi | 112/77 |
| 3,808,991 | 5/1974 | Schaefer, Jr. | 112/121.12 |
| 3,814,038 | 6/1974 | Dorosz et al. | 112/121.15 |
| 3,970,016 | 7/1976 | Yanikoski | 112/121.12 |
| 3,982,491 | 9/1976 | Herzer et al. | 112/121.12 |
| 3,986,466 | 10/1976 | Herzer et al. | 112/121.12 |
| 4,135,462 | 1/1979 | Brown | 112/158 E |
| 4,143,606 | 3/1979 | Herr et al. | 112/158 E |
| 4,309,950 | 1/1982 | Franklin | 112/103 |

FOREIGN PATENT DOCUMENTS

| | | |
|---|---|---|
| 52-11616 | 4/1977 | Japan . |
| 52-37418 | 9/1977 | Japan . |
| 54-104954 | 8/1979 | Japan . |
| 55-58167 | 4/1980 | Japan . |
| 56-355 | 1/1981 | Japan . |

*Primary Examiner*—Peter P. Nerbun

*Attorney, Agent, or Firm*—Robert E. Smith; Edward L. Bell

[57] ABSTRACT

An embroidery attachment for a sewing machine having electronic controls influencing the stitch forming instrumentalities. The attachment work holding frame is shifted by operative connections with the stitch forming instrumentalities. Alternative constructions are disclosed utilizing electronically controlled sewing machine needle bar and feed dog movements to drive the embroidery attachment.

15 Claims, 9 Drawing Figures

Fig. 3.
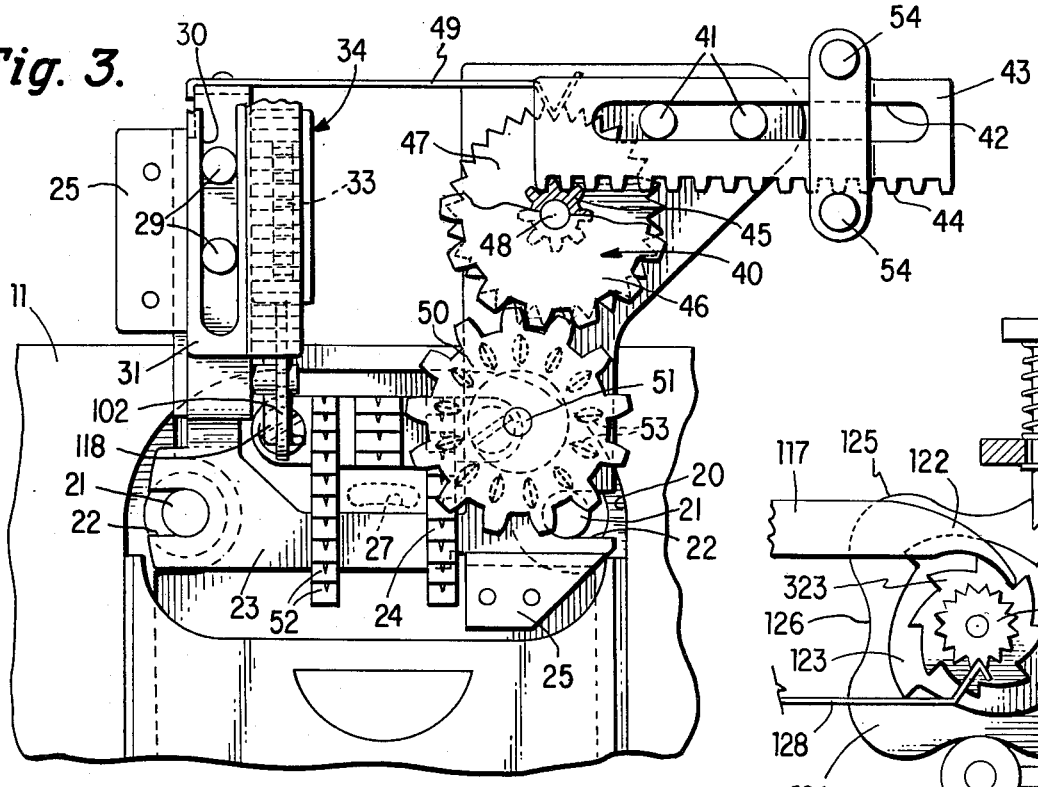
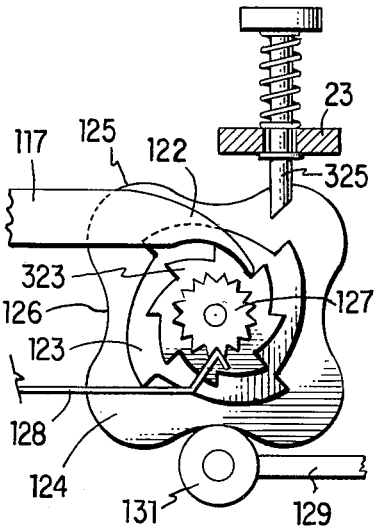
Fig. 9.
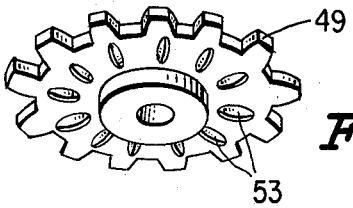
Fig. 4.
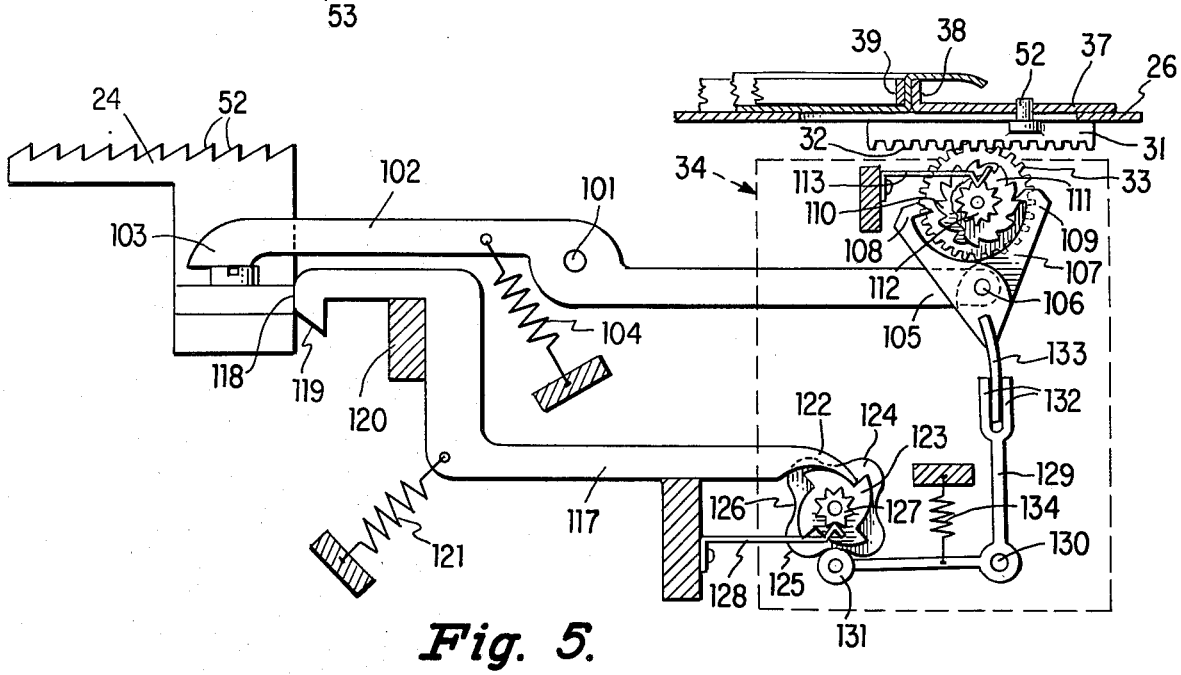
Fig. 5.

EMBROIDERY ATTACHMENT FOR ELECTRONIC SEWING MACHINE

BACKGROUND OF THE INVENTION

This invention relates to sewing machine embroidery or pattern stitching, and more particularly, to arrangements in a sewing machine for automatically performing predetermined group stitch patterns.

It is known primarily in the industrial sewing machine art to provide for the sewing of group stitch patterns such as buttonholes, monograms, and the like by means of a fabric shifting clamp with clamp shifting actuator and pattern means devoted exclusively thereto. In the household sewing machine art, group stitch attachments are well known driven by reciprocation of the needle bar or by motion of a work feed actuator and influenced by self contained patterning means, as for instance, by a pattern cam or the like associated with the attachment.

With the advent of electronic control of stitch pattern formation in sewing machines and the increases in complexity and data storage capacity of electronic memories and data processors as compared with prior art mechanical patterning means such as cams and the like, prospects seem favorable for the execution of group stitch patterns of correspondingly increased complexity by the use of such electronic memories.

While it might be possible to utilize pattern data extracted from an electronic memory for influencing the work shifting frame of a group stitch attachment to a household sewing machine by supplying actuators in the attachment which are responsive to the data extracted from the electronic memory and which are committed specially to driving the work shifting frame, the limited space which is available in such attachments, the excessive costs involved in providing such specially committed actuators, and the necessity to provide electrical connection between the sewing machine and such an attachment all militate against such an approach as a matter of commercial practicability.

It has been proposed to drive a work shifting frame of a group stitching device by harnessing the work transporting capabilities of the sewing machine stitch forming instrumentalities under control of electronic stitch patterning means. In other words, by feeding the work fabric in one direction with the sewing machine feed dog and in another direction by using the sewing machine needle as a work feeding means, the work fabric itself serving as a link in the drive of the work holding frame. There are drawbacks, however, to this proposal; one disadvantage being the undersirability of utilizing the work fabric as a drive link because of uncertainty as to the characteristics of work fabrics for this driving function particularly when the choice of fabrics may be completely out of control of the mechanism designer. Another disadvantage of such a proposal is that to whatever degree the stitch forming instrumentalities are so harnessed to move the work holding frame, the effectiveness of that stitch forming instrumentality simultaneously to produce conventional zig zag stitch patterns is diminished.

SUMMARY OF THE INVENTION

It is an object of the present invention to provide a group stitching mechanism for a sewing machine of the type having electronic memory means for controlling the stitch forming instrumentalities in the sewing of patterns of stitches in which the movement of the work shifting frame of the group stitch mechanism are provided by mechanical linkages to the sewing machine stitch forming instrumentalities. By harnessing motors of the stitch forming instrumentalities including motors which may be separate and distinct from those motions necessary for the conventional formation of patterns of stitches, but which are none-the-less controllable in accordance with data extractible from the electronic memory, an embroidery frame may be shifted accurately to produce group stitch patterns in a particularly cost effective fashion.

The advantages of the present invention, therefore, include the fact that pattern control of the work shifting frame movements are attained by using the same actuators regularly provided for controlling the production of patterns of sewn stitches on the sewing machine and the need for duplication of such actuators is obviated. It is also an advantage of this invention that pattern controlled actuation of the work shifting frame is accomplished by harnessing the stitch forming instrumentalities of the sewing machine without adversely influencing the ability of these instrumentalities simultaneously to perform the sewing of pattern controlled stitches.

It is an object of this invention to provide means for utilizing the movements of one or more of the sewing machine stitch forming instrumentalities during portions of each stitch forming cycle which do not adversely impede the performance of conventional stitch pattern formation so as to provide for simultaneously sewing patterns of stitches while independently driving a work shifting frame.

Another object of this invention is to provide separate mechanical drives in mutually perpendicular directions to a work shifting frame in response to motions of the stitch forming instrumentalities of a sewing machine which are subject to pattern control.

Still another object of this invention is to provide separate mechanical drives in mutually perpendicular directions to a work shifting frame in response to different motions of the same patterned controlled stitch forming instrumentality of a sewing machine.

DESCRIPTION OF THE DRAWINGS

With the above and other objects and advantages in view, this invention will be described with reference to preferred embodiments illustrated in the accompanying drawings in which:

FIG. 3 is an enlarged plan view of a portion of the sewing machine and embroidery attachment of FIG. 2 illustrating the means for driving the work holding frame of the attachment in one direction, FIG. 4 is a perspective view showing the underside of the attachment drive gear and illustrating the teeth thereon which cooperate with the sewing machine feed dog, FIG. 5 is an enlarged elevational view with portions broken away showing a portion of the sewing machine and embroidery attachment of FIG. 2 illustrating the means for driving the work holding frame of the attachment in another direction, FIG. 9 is an elevational view of a modified form of a portion of the mechanism illustrated in FIG. 5.

DESCRIPTION OF THE INVENTION

Figure 1:
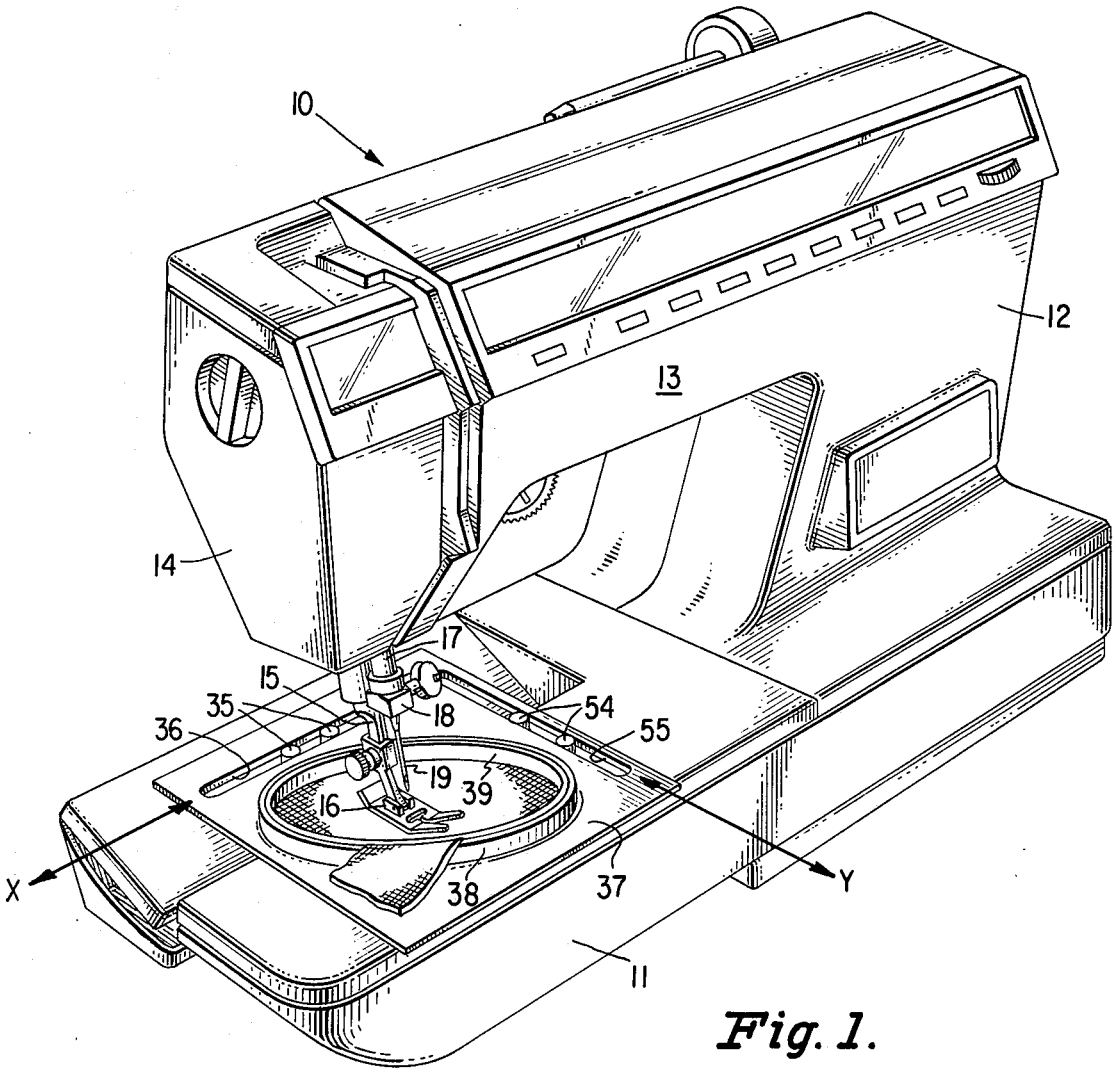
FIG. 1 is a perspective view of a sewing machine having applied thereto an embroidery attachment in accordance with a preferred form of this invention.

The embroidery attachment of this invention is adapted for use with a sewing machine having electronic patterning means influencing the stitch forming instrumentalities in the production of patterns of stitches. It is a feature of this invention that special actuators devoted to driving and controlling the attachment motions are not required, but instead those driving and motion controlling functions are provided by the sewing machine stitch forming instrumentalities and by the same actuators responsive to commands from an electronic memory which control the stitch forming instrumentalities in the regular production of stitch patterns by the sewing machine in the absence of the embroidery attachment.

In order to operate effectively with an embroidery attachment of this invention, an electronic sewing machine, in addition to being physically adapted to accommodate; support and fasten the attachment thereto, must possess or be adapted to accommodate certain electronic capabilities which form a part of this invention. The electronic memory, of course, must be capable of storing pattern data which is dedicated to the particular attachment to be used, and which reflects the specific pattern of stitches which it is desired to produce using the embroidery attachment. In addition, the present invention requires and teaches a novel degree of electronic memory influenced control over the sewing machine stitch forming instrumentalities of which the sewing machine must be capable in order to accommodate the embroidery attachment of this invention.

In the conventional operation of an electronically controlled sewing machine, it is only the final result or culmination of the motion of the stitch forming instrumentalities, which might be called the "primary motion", which is reflected in the resulting stitch pattern. For instance, in the lateral jogging of the needle, it is only the ultimate lateral location of the needle at each work penetration which influences the appearance of the stitch pattern i.e., the path that the needle takes while out of the work between penetrations is not reflected in the regular stitch pattern; and similarly with a work feed dog, it is only the direction and distance which the feed dog moves while in contact with the work which influences the stitch pattern, not the path of motion during the return stroke.

An important aspect of this invention is the provision of electronic control over motions of the stitch forming instrumentalities which do not influence the conventional pattern of stitch formation, which might be called "ancillary motions" of the stitch forming instrumentalities and the use of these ancillary motions to drive and/or control the motions of the work holding frame of an embroidery attachment.

An example of an "ancillary motion" useful in the present invention is the specific path of motion of a sewing machine needle during all or any portion of the interval while the needle is elevated out of the work between needle penetrations. Specifically, the lateral motion of a needle mechanism while at or near the top dead center of each reciprocation is an "ancillary motion" which is not necessarily related to the ultimate lateral position of the needle mechanism at work penetration of the needle. Another example of an "ancillary motion" is the path of movement of a four motion work feed dog during periods when lowered out of engagement with work fabrics.

It is an aspect of this invention and a requirement for an electronic sewing machine to accommodate the embroidery attachment of this invention that the electronic memory of the sewing machine be able to store pattern data for controlling "ancillary motion" as well as "primary motion" of one or more of the sewing machine stitch forming instrumentalities; and that the sewing machine must possess facility such as microcomputive capacity in order to be capable of extracting, distinguishing, and separately applying control signals responsive to each of these types of motion both "primary" and "ancillary" to the stitch forming instrumentalities. Specific electronic attributes and capabilities will be described with respect to each of the embodiments of the invention discussed hereinbelow.

Referring to FIGS. 1 to 5, a preferred embodiment of the embroidery attachment of this invention will now be described in which all of the movements of the attachment are derived from motions of the work feed dog of the sewing machine. It is pointed out that when a device including a driven work holding frame is utilized on a sewing machine, the frame supports the work fabrics in a position out of contact with the work feed dog which, therefore, need not be used in its conventional mode for transporting the work. The feed dog thus provides an advantageous stitch forming instrumentality to be harnessed for driving the embroidery attachment since no problem arises as to conflict with its conventional work transporting function.

As shown in FIG. 1 a sewing machine, which is indicated generally at 10, includes a work supporting bed 11, a standard 12 rising from the bed, and a bracket arm 13 extending from the standard and terminating in a sewing head 14. A presser bar 15 to which a presser foot 16 is secured is carried in the sewing head and biased toward the bed 11. An endwise reciprocable needle bar 17 also carried in the sewing head includes a needle clamp 18 by which a needle 19 is secured to the needle bar.

Figure 2:
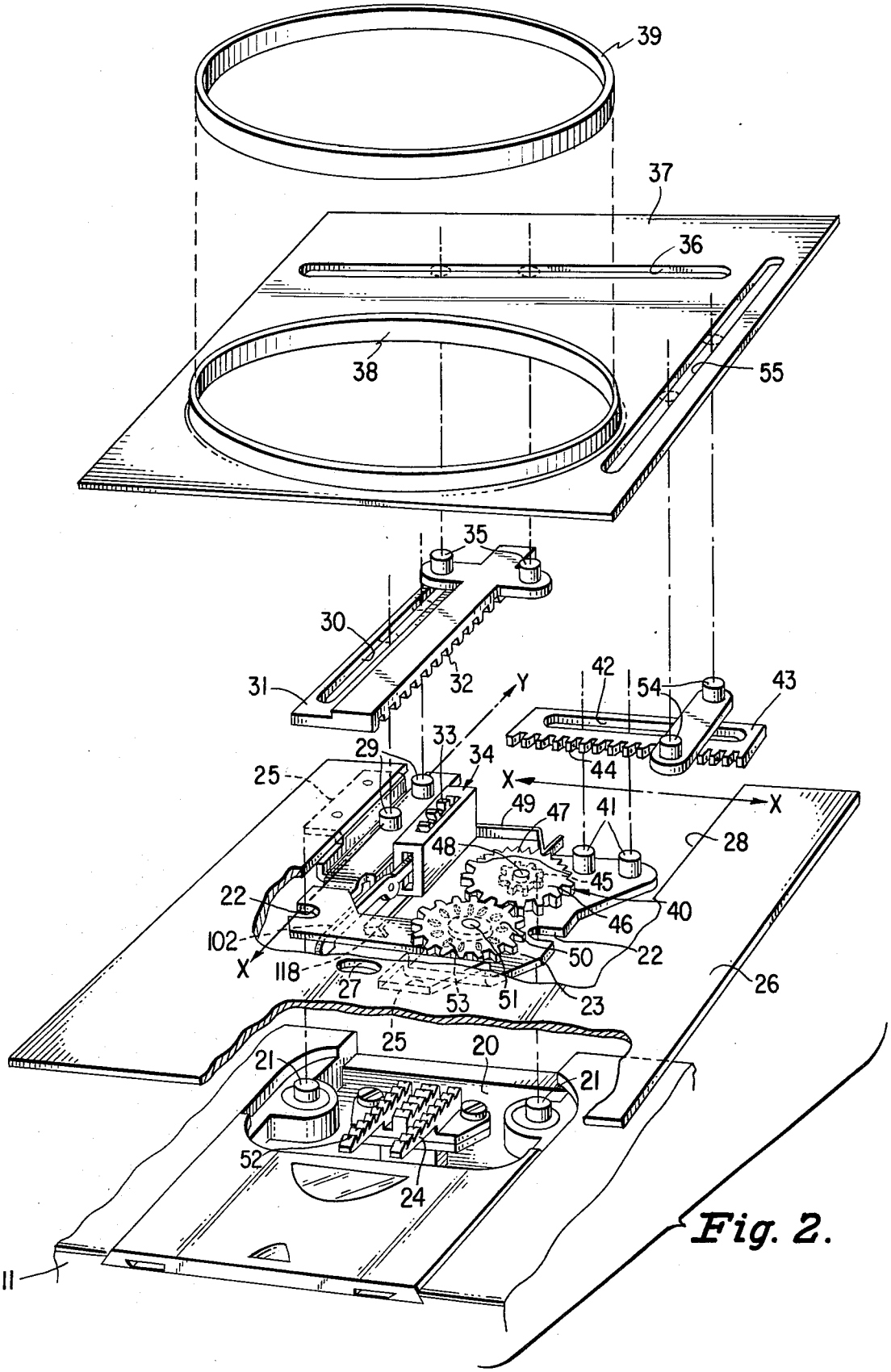
FIG. 2 is a disassembled perspective view of portions of the sewing machine and the preferred form of the embroidery attachment of FIG. 1.

As illustrated in FIG. 2, 20 indicates a recess formed in the bed 11 adapted conventionally to to be closed by a throat plate which is not utilized when the embroidery attachment is employed. Throat plate locating pins 21 cooperate with mating reception seats 22 on an embroidery attachment base 23 for locating and securing the attachment base on the sewing machine bed.

Within the recess 20, a conventional feed dog 24 of a four motion work feed mechanism is arranged; the four motions, referring to the conventional mode of work transport, involve upward motion into work engagement, horizontal motion in engagement with work fabric, downward motion out of work engagement and horizontal return movement out of work engagement.

The attachment base 23 is formed with a plurality of upstanding support flanges 25 to which is secured a cover plate 26 formed with a needle aperture 27 and formed adjacent the needle aperture with an opening 28.

Extending upwardly from the attachment base 23 are spaced guide studs 29 which slidably engage a straight slot 30 in a slide member 31 to guide the slide member for movement in a direction along a line Y—Y extending transversely across the bed 11 of the sewing machine. A rack 32 is formed beneath the slide member 31 which is arranged in mesh with a gear 33 which is part of a Y—Y direction attachment drive mechanism indicated generally at 34 which is carried on the attachment base 23.

Extending upwardly from the slide member 31 are spaced guide studs 35 arranged along a line which is perpendicular to the slot 30. The guide studs 35 engage a straight slot 36 in a work supporting frame 37 formed with a rimmed aperture 38 for accommodating a work fabric to be stitched and complimented by a clamp hoop 39 for securing the work fabric to the rimmed aperture.

Included in FIG. 2, but best illustrated in FIG. 3, is an X—X direction drive mechanism, indicated generally at 40. The attachment base 23 carries a spaced pair of guide studs 41 arranged along a line X—X which is perpendicular to the line Y—Y defined by the guide studs 29. The guide studs 41—41 engage a straight slot 42 in a slide member 43 formed along one side with a rack 44 held in mesh with a pinion 45 by the guide studs 41. The pinion 45 is secured for rotation with a gear 46 and with a peripherally notched detent wheel 47 journaled as a unit on a pivot pin 48 in the attachment base 23. Cooperating with the detent wheel 47 is a spring detent finger 49. The gear 46 meshes with a drive gear 50 which is rotatable on a stud 51 in the attachment base and overlies the feed dog 24.

As shown in FIGS. 2-5, the feed dog 24 may be of conventional construction and formed with teeth or serations 52 on its upper surfaces. Depending from the drive gear adjacent the periphery thereof are an annular array of cogs 53 which as shown in FIG. 4 are each tapered substantially to match the shape of the feed dog teeth 52. Furthermore, each cog 53 is preferably elongate radially of the drive gear as shown in FIGS. 3 and 4 to span any irregularity in the feed dog teeth since the cogs travel in an arcuate path while the feed dog teeth move linearly. The feed dog 24, therefore, in engaging the cogs 53 imparts turning increments to the drive gear 50 in a direction depending upon the direction forward or reverse of the feed dog movement. Such drive gear movement is transmitted by the gear 46, the pinion 45, and the rack 44, to the slide member 43.

The slide member 43 is formed with a pair of upwardly extending guide studs 54—54 spaced along a line perpendicular to the line X—X and arranged in engagement with a straight slot 55 in the work supporting frame 37, which slot is perpendicular to the slot 36 of the frame. It will be appreciated that the drive of the work holding frame 37 in the direction X—X relatively to the sewing machine bed 11 by way of the X—X direction drive mechanism 40 is influenced by the sense of the same stroke of the feed dog 24 which influences work fabric transport in conventional sewing mode of the sewing machine. In this specification the word "direction" will be used to connote the path of motion and the word "sense" will be used to connote the course, either positive or negative, along the path or direction in which the motion proceeds.

A variant of the X—X direction drive from the feed dog, which is particularly adapted for use where a rubber coated feed dog is employed, involves the use of a drive gear 50 of which the undersurface in place of the cogs 53, carries a high friction material. With this variant, a finer toothed detent wheel 47 is preferrable so that a wide variation in the magnitude of each increment of work clamp movement in the X—X direction is attainable.

For influencing the work holding frame motion in the Y—Y direction, the Y—Y direction drive mechanism 34 will now be described with particular reference to FIG. 5.

Carried on a pivot pin 101 in the attachment base 23 is an incrementing lever 102 formed at one extremity with a probe 103 engageable with the feed dog or the feed bar to which the feed dog is attached and responsive to vertical motion of the sewing machine feed dog 24. A light spring 104 may be employed to maintain the probe 103 on the feed dog. The opposite extremity 105 of the incrementing lever 102 carries a pivot pin 106 on which a yoke 107 is carried. The yoke 107 is formed with a spaced pair of ratchet fingers 108, 109 disposed one on each side of a pair of ratchet wheels 100, 111 each with ratchet teeth inclined in the opposite direction, the spacing between the fingers 108, 109 being such as to provide for selective engagement thereof with a respective one of the ratchet wheels 110, 111 depending upon the inclination of the yoke 107 on the pin 106. The ratchet wheels 110, 111 are fast on the gear 33 and may also be fast with a detent wheel 112 engaged by a spring loaded detent finger 113. At each cycle of movement of the sewing machine feed dog 24, therefore, the yoke 107 will rise and fall effecting an increment of turning movement to the ratchet wheel 110, 111 and gear 33 assembly either clockwise or counterclockwise depending upon the inclination of the yoke 107 relative to the pivot pin 106.

For influencing the yoke inclination, a slidable interposer bar 117 is provided having a probe 118 at one extremity arranged beyond the normal path of travel of the feed dog 24 but within the path of travel of an abnormal horizontal movement of the feed dog, preferrably during the lowered or return stroke of the feed dog. Preferrably the probe 118 is beveled as at 119 on the underside to prevent its being inadvertently caught and lifted by the feed dog during a feed lift movement. An abutment 120 formed on the attachment base 23 provides a stop against which the interposer bar 117 is biased by a spring 121. At the opposite extremity of the interposer bar 117 from the probe 118, a pawl 122 is formed which is arranged to cooperate with a toothed ratchet 123 secured to a cam 124 having alternating peripheral lobes 125 and depressions 126. A detent wheel 127 having twice as many teeth as the ratchet 123 and cooperating with a spring detent finger 128 may also be secured for rotation with the ratchet 123. A bell crank 129 fulcrumed as at 130 on the attachment base 23 is provided with a cam follower 131 on one extremity and at the other extremity is bifurcated as at 132 to embrace a spring 133 depending from the yoke 107. A spring 134 is employed to bias the cam follower 131 against the cam 124.

The operation of the interposer device above described is as follows. The cam 124 provides for alternate positions of the follower 131 sustaining either one or the other of the yoke ratchet fingers 108 or 109 in position for engagement with its respective ratchet wheel. Two different degrees of abnormal horizontal movement of the feed dog are provided for; a small movement shifting the ratchet 123 one half increment, or a large movement shifting the ratchet 123 a full increment. Of course, a third possibility exists wherein no abnormal feed dog motion occurs in which the ratchet 123 remains unchanged in position. Regardless of the previous position of the ratchet 123, a small abnormal feed dog movement will insure one half ratchet increment of movement leaving the follower 131 tracking a depression 126 of the cam 124 and positioning the yoke 107 with the ratchet finger 109 in cooperation with the ratchet wheel 111 resulting in clockwise movement of gear 33. Similarly, a large abnormal feed dog movement will always result in a cam lobe 125 in engagement with the follower 131 positioning ratchet finger 108 in cooperation with ratchet wheel 110 for a counterclockwise movement of the gear. The rotational direction of rotation of the ratchet and gear 33 will determine the sense of the motion imparted to the work holding frame along the Y—Y direction. Preferrably, an abnormal feed dog movement is influenced prior to the first stitch of any pattern to predetermine the sense of the work holder frame motion in the Y—Y direction, thereafter, the interposer bar 117 need be actuated only when a change in that sense of motion is required.

Movement of the needle bar and feed regulator actuators is preferably under the control of the microcomputer utilized for controlling the overall operation of the sewing machine. Operation of a sewing machine under microcomputer control is presently well known in the art and is described for example in U.S. Pat. No. 4,318,357, which is incorporated herein by reference. For the embodiment, as illustrated in FIGS. 1 to 5, where both the X—X and Y—Y direction of movements are controlled by the work feed mechanism, the conventional work feeding stroke of the feed dog, which can vary in magnitude and sense, controls the X—X direction and sense of motion, and the up/down motion of the feed dog imparts fixed increments of motion in the Y—Y direction, the sense being set by two different degrees of abnormal motion of the feed dog. If it is desired to impart fixed increments of motion in both X—X and Y—Y directions, then there are nine possible modes of influencing the feed, one of which must be identified by information extracted from the memory for each stitch. That is, there are three possible values for the X—X direction (positive, negative, or zero sense) and three possible abnormal motion possibilities to influence the Y—Y sense (i.e., small abnormal motion for positive sense, large abnormal for negative sense, or no abnormal motion to leave the direction unchanged from the last stitch). Therefore, at each feed synchronization time, the microcomputer extracts from the pattern store in place of feed information, one of nine signals identifying one of the nine possible modes of influencing the feed. The microcomputer then utilizes the extracted signal as an address into a table which for each of the nine modes holds two complete five bit feed data groups which are sequentially applied to the feed actuator. First there is applied a data group which calls for the abnormal motion, if any, of the feed dog to set the sense of the Y—Y ratchet assembly. Next, after a sufficient period of time which depends upon the response of the actuator system, the second feed data group which sets the feed stroke for the X—X direction is applied to the feed actuator system. In the event that the Y—Y direction is unchanged from the preceding stitch, both feed data groups may be the same.

Figure 6:
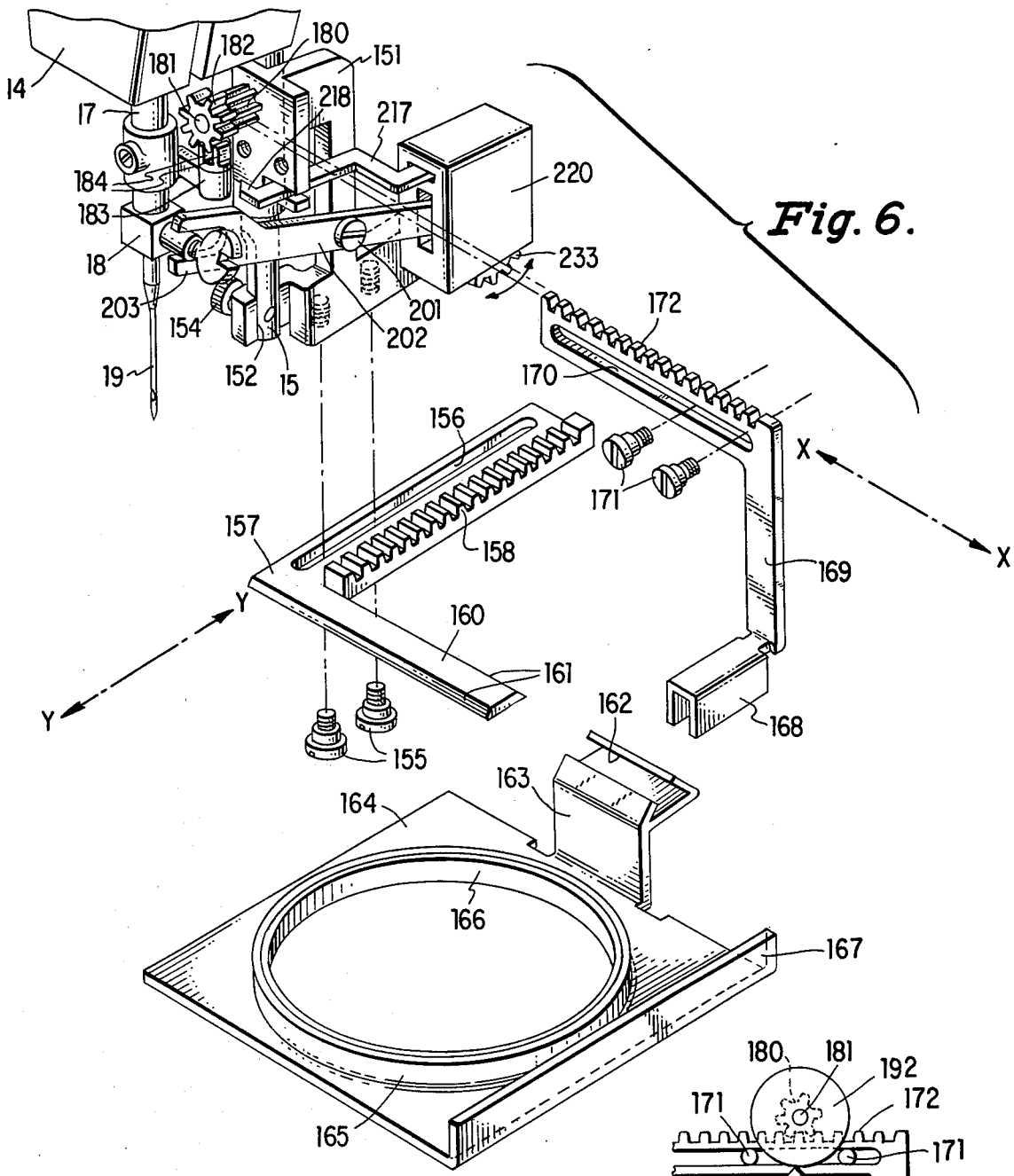
FIG. 6 is a disassembled perspective view of portions of a sewing machine and a modified form of an embroidery attachment therefor in accordance with this invention.
Figure 7:
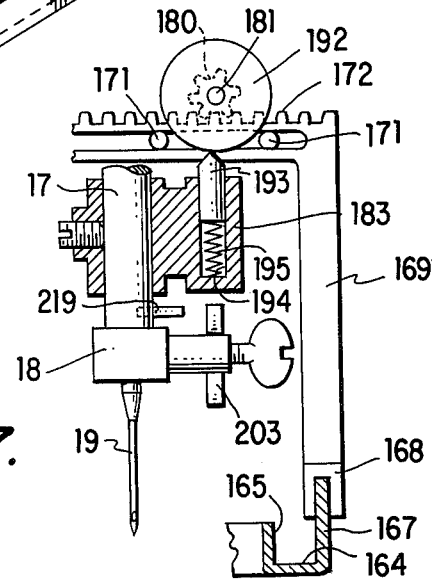
FIG. 7 is an elevational view with portions broken away showing a portion of the sewing machine and embroidery attachment of FIG. 6 illustrating a further modified means for driving the work holding frame of the attachment in one direction.

Referring now to FIGS. 6 and 7, a modified form of our invention will now be described in which movements of the work fabric in mutually perpendicular directions are all derived from movements of the sewing machine needle bar 17.

In this modified form of construction, an attachment frame 151 is provided which is formed with a reception seat 152 adapted to accommodate the conventional sewing machine presser bar 15 and to be secured thereto by a thumb screw 154 in place of a conventional presser foot. Guide studs, which preferrably comprise headed shoulder screws 155 depending from the attachment frame 151 and arranged along a line Y—Y pass through a straight slot 156 formed in a slide member 157 which is formed alongside the slot 156 with a raised gear rack 158. A lateral extension 160 of the slide member 157 which extends at right angles to the straight slot 156 and is formed with beveled edges 161 is accommodated slidably in an undercut recess 162 formed in a production 163 rising from one side of a work holding frame 164. The frame 164 may be formed with a rimmed aperture 165 cooperating with a clamp hoop 166 securely to attach a work fabric thereto after the fashion of an embroidery hoop.

Along an adjoining side of the work holding frame substantially perpendicular to the undercut recess 162 the work holding frame is formed with a raised straight lip 167 which is slidably embraced by a bifurcated depending limb 168 of a slide member 169 formed with a slot 170 accommodating guide studs 171—171 secured on the attachment frame 151. The guide studs 171—171 preferrably comprise headed shoulder screws and are arranged along a line X—X substantially perpendicular to the line Y—Y. The slide member 169 is additionally formed with an upstanding gear rack 172 parallel to the slot 170.

For imparting movements to the slide member 169 along the line X—X and hence for moving the work holding frame in this direction, a pinion 180 is journalled on a pin 181 in the attachment frame 151 and arranged in mesh with the rack 172. Fast on the pinion 180 is a gear wheel 182 which, as shown in FIG. 6, is arranged adjacent to the needle bar 17 of the sewing machine and vertically above a bracket 183 secured to the needle bar 17. The bracket 183 is formed with upwardly extending spaced fingers 184—184 adapted to embrace a tooth of the gear wheel 182 during the upper portion of each needle bar stroke.

It will be apparent that only during a small increment of needle bar reciprocation at the upper portion of needle bar stroke while the needle 19 is raised out of a work fabric being stitched, will the fingers 184 of the bracket 183 engage the teeth of the gear wheel 182. The pitch of the teeth of the gear wheel 182 will determine a preferential magnitude of needle jogging motion during this small increment of the needle bar stroke, and the direction of lateral jogging will determine the sense of movement which will be directly transmitted by way of the pinion 180, rack 172 and slide member 169 to provide work holding frame movements parallel to the line X—X.

For imparting movements to the slide member 157 along the line Y—Y and hence for moving the work holding frame in Y—Y direction, a mechanism quite similar to that illustrated in FIG. 5 is employed, operated, however, from endwise reciprocatory movements of the needle bar 17 rather than from rising and falling movements of the feed dog and with the sense of the movement being influenced in response to different degrees of abnormal jogging movements of the needle 17 rather than in response to abnormal degrees of feed movement of the feed dog.

As shown in FIG. 6, the attachment frame 151 has pivoted thereon at 201 a lever 202, which is bifurcated at as 203, to embrace the screw of the needle clamp 18 on the sewing machine needle bar 17. The lever 202 is the equivalent of the lever 102 of the embodiment illustrated in FIG. 5. Also carried on the attachment frame 151 is an interposer bar 217, formed with a probe 218 arranged in the path of abnormal jogging movement of the needle bar 17. The interposer 217 is the equivalent of the interposer bar 117 of the embodiment shown in FIG. 5. The remainder of the Y—Y direction motion generating mechanism, which may be identical to that illustrated in FIG. 5, is arranged in a housing 220 on the attachment frame 151 from which protrudes a gear 233, which is the equivalent of gear 33 shown in the embodiment of FIG. 5. Gear 233 is arranged in mesh with the rack 158 to transmit motion in the Y—Y direction to the work holding frame.

The above described mechanism for imparting movement to the work holding frame parallel to the line Y—Y thus provides for an increment of movement in the direction Y—Y during each reciprocation of the needle bar 17 with the sense of such motion depending upon the inclination of the yoke 107 which is influenced by overthrow jogging motion of the needle bar with a small overthrow causing Y—Y direction movement in one sense, large overthrow causing movement in the opposite sense, and no overthrow leaving the sense unchanged.

A variant of the X—X direction drive from the needle bar is illustrated in FIG. 7. In this variant, the parts are identical with those illustrated in FIG. 6 except that in place of the gear wheel 182, a smooth friction wheel 192 is employed, and in place of the spaced fingers 184—184 extending upwardly from the bracket 183 on the needle bar 17, a plunger 193 formed of hard rubber or the like is slidable in a blind bore 194 in the bracket 183 and biased upwardly by a coil spring 195. Because of the absence of teeth on the friction wheel 192, the magnitude of each increment of motion in the X—X direction may be infinitely varied within the lateral jogging capacity of the needle bar and not preferentially limited by the gear teeth pitch as in the form of construction illustrated in FIG. 6.

Thus, in the embodiment illustrated in FIGS. 6 and 7 motion of the needle bar within a specific top range of the needle bar stroke controls the X—X direction. An abnormal lateral overthrow of the needle bar sets the sense of motion along the Y—Y direction. The up/-down motion of the needle bar imparts a fixed increment of Y—Y motion. As was the case with the total feed control illustrated in FIGS. 1 to 5, the microcomputer may extract a signal which is used to address into a special table to get the actual code for controlling the bight actuator. Due to timing limitations caused by the response time of the actuator system, which also has to move the needle bar to the proper position for forming the stitch after the attachment work shifting mechanism has been moved, there may not be sufficient time to move in the X—X direction if the Y—Y sense must be changed. Accordingly, during any stitch in which the Y—Y sense is to be changed it may be preferential that there be no X—X movement, and this may result in the necessity at these times to provide an extra stitch in the pattern. However, the satin stitching for forming monogram patterns is sufficiently dense and includes such a large number of stitches that an occasional extra stitch will not be noticable.

Figure 8:
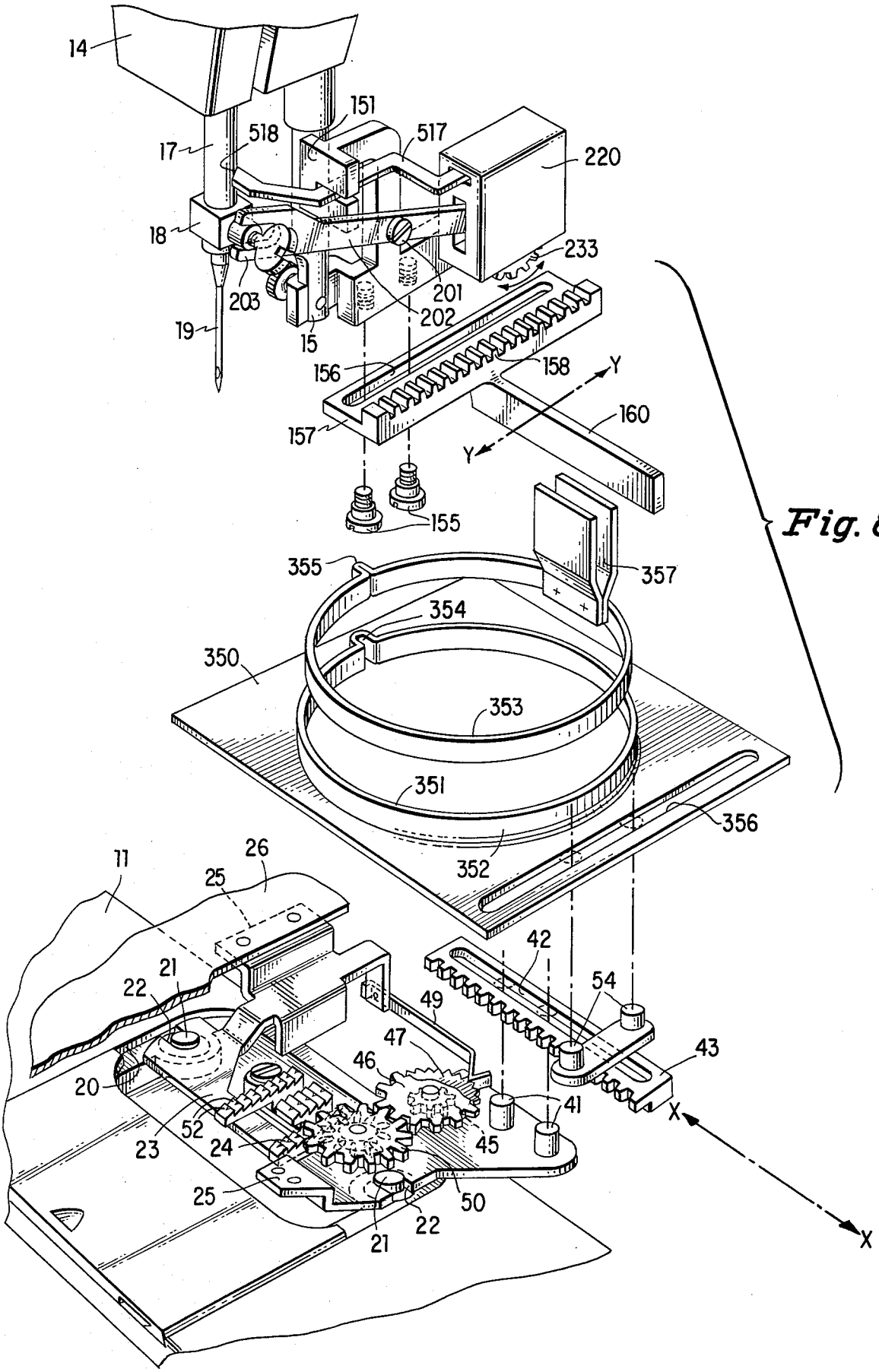
FIG. 8 is a disassembled perspective view of portions of a sewing machine and a further modified form of an embroidery attachment therefor in accordance with this invention.

Referring to FIG. 8, another modified form of our invention will now be described in which electronically controlled motion of the needle bar 17 is harnessed to impart movement to a work holding frame 350 in the Y—Y direction while electronically controlled movement of the feed dog 24 is harnessed to impart movement in a perpendicular direction X—X to the work holding frame.

The work holding frame 350, in this modified form, includes an aperture 351 formed with a rim 352, on which a work fabric may be held stretched by a top clamp 353. The aperture rim 352 and top clamp 353 are each formed with a complimentary irregularity 354, 355 establishing a predetermined orientation therebetween. Along one side of the work holding frame parallel to the Y—Y direction, a straight slot 356 is formed, while on the top clamp 352 an upwardly open guide slot 357 is formed.

The mechanism harnessing motion of the needle bar 17 to impart work holding frame motion in the Y—Y direction may be substantially identical to that disclosed in FIG. 6 and described hereinbefore. In FIG. 8, reference characters assigned to the salient parts of the Y—Y direction influencing mechanisms which are identical to those of FIG. 6 have been marked with the same reference characters. As shown in FIG. 8, the lateral extension 160 of the slide member 157, however, is formed without the beveled edges 161, and is simply arranged slidably within the guide slot 357 of the top clamp 353 of the work holding frame. The other difference from the mechanism disclosed in FIG. 6 concerns the shape of the interposer bar 517. Because a bracket 183 and upstanding fingers 184—184 for influencing X—X motion drive are not required in the embodiment disclosed in FIG. 8, the interposer bar 517 is made longer with the probe 518 arranged for engagement by the needle bar 17 during abnormal jogging movements of the needle bar.

The mechanism harnessing motion of the work feed dog 24 to impart work holding frame motion in the X—X direction may be identical to that disclosed in FIGS. 2 to 5 and described hereinbefore. In FIG. 8, reference characters assigned to the salient parts of the X—X direction influencing mechanisms which are identical to those of FIGS. 2 to 5, have been marked with the same reference characters. As shown in FIG. 8, the attachment base 23 is employed as in the embodiment of FIGS. 2 to 5, but the Y—Y direction drive mechanism 34 is omitted.

The guide studs 54—54 of the slide member 43, in the embodiment of FIG. 8, engage the straight slot 356 in the work holding frame 350.

In the embodiment of FIG. 8, the normal stroke of the feed dog 24 controls the X—X movement. Abnormal lateral needle bar overthrow is utilized to set the sense of motion along the Y—Y direction. The needle bar up/down motion is utilized to impart a fixed increment in the Y—Y direction. In this case, the conventional electronic feed information in the memory may be utilized to set the feed stroke and direction. The bight information stored in the memory includes a signal which is utilized as an address into a special table, the entries of which includes bight data groups used for influencing the abnormal overthrow of the needle jogging motion to set the sense of motion along the Y—Y direction. The memory may also include stitch pattern data for influencing jogging of the needle after abnormal overthrow so as to produce a zig zag stitch pattern appropriate for the group stitch configuration dictated by the movements of the work holding frame.

It will be appreciated from the above descriptions of the various modifications of this invention, that it is within the teaching of this invention to utilize either the jogging motion of a sewing machine needle bar alone, the motions of a work feeding instrumentality alone, or a combination of the motions of both of these stitch forming instrumentalities to shift the work holding frame of an embroidery attachment in mutually perpendicular directions. Moreover, either the needle bar or the work feed dog may be harnessed selectively or simultaneously in the two different modes to generate work clamp motion.

Where the stitch forming instrumentality is harnessed as in FIG. 7, a varying increment of work clamp motion may be imparted from zero to a maximum which is a function of the maximum normal excursion of the stitch forming instrumentality. This has the advantage of providing an infinitely variable step within the total possible range. Where the stitch forming instrumentality is harnessed as in FIG. 3 or 5, a fixed increment of work clamp motion is imparted during each stitch forming cycle and the electronic controls of the sewing machine can influence only the sense of such fixed increment. This can be advantageous where a uniform density of stitches within a group stitch pattern is desired as is usually the case where uniform density of satin stitching is desired as in monogramming and the like.

It will be understood, however, that the various modes of work clamp actuation disclosed herein may be interchanged as desired.

In the mode of harnessing a stitch forming instrumentality as disclosed in FIG. 5, wherein abnormal motion of the stitch forming instrumentality is sensed in order to influence the sense of fixed incremental work clamp motion, the construction and arrangement illustrated and described hereinabove involves the generation selectively of two different degrees of abnormal stitch forming instrumentality motion. Such an arrangement is preferred because the electronic signals influencing such abnormal motion can dictate the direction of work clamp motion with certainty. An alternative construction and arrangement is possible wherein only one degree of abnormal motion of the stitch forming instrumentality is involved, which upon each occurrence, simply changes the direction of work clamp movement to the opposite of its previous condition. An arrangement to effect this alternative mode of operation is illustrated in FIG. 9, in which in addition to the ratchet wheel 123 another ratchet wheel 323 is provided formed with twice the number of teeth utilized by the ratchet wheel 123, and the pawl 122 of interposer bar 117 is disposed in cooperative relation with the added ratchet wheel 323. If this alternative is adopted, a somewhat simpler set of electronic control signals will be required, but provision must be included for initializing the work clamp movement in a known or predetermined sense. A mechanical arrangement for at will establishing a known inclination of the ratchet pawl set may comprise an operator influenced finger 325 which is spring biased upwardly, disposed in cooperative relation with the ratchet wheel 123, and arranged such that upon depression the cam will be positioned with a lobe 125 engaging the follower 131.

For the purpose of influencing movements of a work holding frame, this invention contemplates retrieving pattern data from an electronic memory for controlling movements of the sewing machine stitch forming instrumentalities which is separate and independent from that utilized in conventional pattern stitch formation during operation of the sewing machine.

Furthermore, mechanical drives are provided responsive to the pattern controlled movements of the stitch forming instrumentalities for influencing movements of the work holding frame in a reliable and predictable manner.

In providing the pattern controlled movements of the work holding frame in accordance with this invention, the same actuators and drive linkages thereto are utilized as are required for influencing control of the sewing machine stitch forming instrumentalities in the conventional sewing of patterns of stitches in accordance with electronically stored pattern information. No electromechanical actuators nor electrical connections are required to the attachment frames, bases or work holding frames in any of the modifications of this invention. As a result, a cost effective mechanical group stitch sewing arrangements are provided which are capable of operation in accordance with electronically stored data to provide for the sewing of complex patterns of practically unlimited numbers of stitches.

We claim:

1. An embroidery attachment for a sewing machine having stitch forming instrumentalities including an endwise reciprocatory and lateral jogging needle bar and a work feeding member, a memory in which data is stored for influencing movements of said stitch forming instrumentalities, and means responsive to data extracted from said memory for influencing movements of said stitch forming instrumentalities, including the lateral jogging movements of said needle into predetermined position prior to each work penetrating endwise reciprocation in the formation of patterns of stitches without benefit of an embroidery attachment, said embroidery attachment comprising a work holding frame supported on said sewing machine for movement in angularly related directions, operative connections between said work holding frame of said embroidery attachment and said sewing machine stitch forming instrumentalities responsive to movements of said stitch forming instrumentalities for imparting movements to said work holding frame in each of said angularly related directions, and means responsive to data extracted from said memory including data unrelated to that for influencing patterns of stitches without benefit of an embroidery attachment for influencing movement of at least one of said stitch forming instrumentalities to control the magnitude and sense of movement of said work holding frame.

2. An embroidery attachment as set forth in claim 1 in which separate operative connections are provided between said work holding frame and at least one of said sewing machine stitch forming instrumentalities for imparting movement to said work holding frame in each of said angularly related directions.

3. An embroidery attachment as set forth in claim 2 in which said work holding frame is supported on said sewing machine for movement in mutually perpendicular directions.

4. An embroidery attachment as set forth in claim 1 in which at least one of said operative connections between a stitch forming instrumentality of said sewing machine and said work holding frame is effective during only a portion of each cycle of movement of said stitch forming instrumentality and transmits to said work hold frame a movement which is directly proportional to the magnitude and sense of motion of said stitch forming instrumentality during said effective portion of each cycle of movement thereof.

5. An embroidery attachment as set forth in claim 1 in which at least one of said operative connections between a stitch forming instrumentality and said work holding frame includes means continuously engaged with said stitch forming instrumentality and arranged to impart a fixed increment of movement in one of said directions to said work holding frame during each cycle of motion of said stitch forming instrumentality, and means responsive to abnormal motion of a stitch forming instrumentality for influencing the sense of said fixed increment of movement along said one direction.

6. An embroidery attachment as set forth in claim 5 in which said means responsive to abnormal motion of said stitch forming instrumentality for influencing the sense of said fixed increment of movement comprises means responsive to one degree of abnormal motion of said stitch forming instrumentality for influencing movement in one sense, and means responsive to an extent of abnormal motion of said stitch forming instrumentality greater than said one degree for influencing movement in the opposite sense.

7. An embroidery attachment as set forth in claim 5 in which said means responsive to abnormal motion of said stitch forming instrumentality for incluencing the sense of said fixed increment of movement comprises means responsive to only one degree of abnormal motion of said stitch forming instrumentality for influencing a reversal of the sense of said movement upon each occurrance of said abnormal motion of said stitch forming instrumentality in combination with operator influenced means effective to establish a predetermined sense of said motion.

8. An embroidery attachment as set forth in claim 2 in which said operative connections for imparting movement to said work holding frame in each of said angularly related directions includes means continuously engaged with said at least one said stitch forming instrumentalities and arranged to impart fixed increments of movement in each of said directions to said work holding frame during each cycle of motion of said stitch forming instrumentalities.

9. An embroidery attachment as set forth in claim 2 in which said operative connections for imparting movement to said work holding frame in one of said angularly related directions is effective during only a portion of each cycle of movement of said stitch forming instrumentality and transfers to said work holding frame a movement which is directly proportional to the magnitude and sense of motion of said stitch forming instrumentality during said effective portion of each cycle of movement thereof, and in which said operative connections for imparting movement to said work holding frame in the other of said directions includes means continuously engaged with said stitch forming instrumentality and arranged to impart a fixed increment of movement in one of said directions to said work holding frame during each cycle of motion of said stitch forming instrumentality, and means responsive to abnormal motion of said stitch forming instrumentality for influencing the sense of said fixed increment of movement along said one direction.

10. An embroidery attachment as set forth in claim 2 in which separate operative connections are provided between the work holding frame and the work feeding instrumentality of said sewing machine for imparting movement to said work holding frame in each of said angularly related directions.

11. An embroidery attachment as set forth in claim 10 in which the work feeding instrumentality of said sewing machine comprises a four motion feed dog having vertical rising and falling motions and horizontal feed and return motions, in which first operative connections are provided between the work holding frame and the feed dog comprising a wheel rotatable on said attachment and arranged for driven engagement with said feed dog adjacent the periphery of said wheel during at least a portion of a horizontal motion of said feed dog, and means for transmitting turning movements of said wheel to movements of said work holding frame in one of said directions, in which second operative connections are provided between the work holding frame and the feed dog comprising lever means carried on said attachment responsive to vertical motions of said feed dog, a pair of ratchet and pawl drives responsive to movements of said lever means for imparting a fixed increment of movement to said work holding frame each in the opposite sense along the other of said directions during each four motion cycle of operation of said feed dog, and a probe carried by said attachment and arranged in the horizontal path of motion of said feed dog and responsive to abnormal horizontal motion of said feed dog for rendering effective a selected one of said pair of ratchet and pawl drives.

12. An embroidery attachment as set forth in claim 2 in which separate operative connections are provided between the work holding frame and the endwise reciprocatory and laterally jogging needle bar of said sewing machine for imparting movement to said work holding frame in each of said directions.

13. An embroidery attachment as set forth in claim 12 in which first operative connections are provided between the work holding frame and said needle bar comprising a wheel rotatably associated with said attachment and arranged for driven engagement with the needle bar adjacent the periphery of said wheel during a portion of the lateral jogging motion of said needle bar, and means for transmitting turning movements of said wheel to movements of said work holding frame in one of said directions, in which second operative connections are provided between the work holding frame and the needle bar comprising lever means carried on said attachment responsive to endwise reciprocatory movements of said needle bar, a pair of ratchet and pawl drives responsive to movements of said lever means for imparting a fixed increment of movement to said work holding frame each in the opposite sense along the other of said directions during each reciprocation of said needle bar, and a probe carried by said attachment and arranged in the path of lateral jogging motion of said needle bar and responsive to abnormal lateral jogging movement of said needle bar for rendering effective a selected one of said pair of ratchet and pawl drives.

14. An embroidery attachment as set forth in claim 2 in which first operative connections are provided between the work holding frame and the work feeding instrumentality of the sewing machine for imparting movement to said work holding frame in one direction, and second operative connections are provided between the work holding frame and the endwise reciprocatory and laterally jogging needle bar for imparring movements to said work holding frame in the other direction.

15. An embroidery attachment as set forth in claim 14 in which said first operative connections between the work holding frame and the work feeding instrumentality comprise a wheel rotatably carried on said attachment and arranged for driven engagement with said feed dog adjacent the periphery of said wheel during at least a portion of a horizontal motion of said feed dog, and means for transmitting turning movements of said wheel to movements of said work holding frame in one of said directions, and in which said second operative connections between the work holding frame and the endwise reciprocatory and laterally jogging needle bar comprise lever means carried on said attachment responsive to endwise reciprocating movements of said needle bar, a pair of ratchet and pawl drives responsive to movements of said lever means for imparting a fixed increment of movement to said work holding frame each in the opposite sense along the other of said directions during each reciprocation of said needle bar, and a probe carried by said attachment and arranged in the path of lateral jogging motion of said needle bar and responsive to abnormal lateral jogging movement of said needle bar for rendering effective a selected one of said pair of ratchet and pawl drives.

* * * * *